US006869373B1

(12) United States Patent
Byrne et al.

(10) Patent No.: US 6,869,373 B1
(45) Date of Patent: Mar. 22, 2005

(54) KNOB FOR A METAL BALL BAT AND METHOD OF ATTACHING KNOB

(75) Inventors: Robert M. Byrne, Lima, OH (US); Kurt F. Hafeken, Sr., Elida, OH (US)

(73) Assignee: American Trim, LLC, Lima, OH (US)

( * ) Notice: Subject to any disclaimer, the term of this patent is extended or adjusted under 35 U.S.C. 154(b) by 117 days.

(21) Appl. No.: 10/195,828

(22) Filed: Jul. 15, 2002

Related U.S. Application Data

(63) Continuation-in-part of application No. 09/637,235, filed on Aug. 11, 2000, now Pat. No. 6,443,860.

(51) Int. Cl.[7] ..... A63B 59/06
(52) U.S. Cl. ..... 473/568
(58) Field of Search ..... 473/564–568, 473/457, 519, 520

(56) References Cited

U.S. PATENT DOCUMENTS

| | | | | |
|---|---|---|---|---|
| 1,026,990 A | | 5/1912 | Matson | |
| 1,499,128 A | | 6/1924 | Shroyer, Jr. | |
| 1,611,858 A | | 12/1926 | Middlekauff | |
| 2,379,006 A | | 6/1945 | Johnson | 273/72 |
| 3,691,625 A | | 9/1972 | Swenck | 29/557 |
| 3,703,290 A | | 11/1972 | Wilson | 273/72 A |
| 3,735,473 A | * | 5/1973 | Wilson | 29/419.2 |
| 3,779,551 A | | 12/1973 | Wilson | 273/72 A |
| 3,841,130 A | | 10/1974 | Scott, Jr. et al. | 72/70 |
| 4,000,895 A | | 1/1977 | Scott, Jr. et al. | 273/72 A |
| 4,063,732 A | | 12/1977 | Scott et al. | 273/72 A |
| 4,089,199 A | | 5/1978 | Siemonsen | 72/370 |
| 4,131,981 A | | 1/1979 | Scott et al. | 29/505 |
| 4,177,989 A | | 12/1979 | Easton et al. | 273/72 A |
| 4,248,425 A | | 2/1981 | Easton et al. | 273/72 A |
| 4,569,521 A | | 2/1986 | Mueller | 273/72 A |
| 4,768,785 A | | 9/1988 | Patterson | 273/26 B |
| 4,940,247 A | | 7/1990 | Magadini | 273/72 A |
| 5,094,453 A | | 3/1992 | Douglas et al. | 273/72 A |
| 5,380,003 A | | 1/1995 | Lanctot | 273/72 R |
| 5,409,214 A | | 4/1995 | Cook | 273/72 R |
| 5,421,572 A | | 6/1995 | MacKay, Jr. | 273/72 A |
| 5,511,777 A | | 4/1996 | McNeely | 273/72 A |
| 5,593,158 A | | 1/1997 | Filice et al. | 473/520 |
| 5,785,614 A | | 7/1998 | MacKay, Jr. | 473/566 |
| 5,785,617 A | | 7/1998 | MacKay, Jr. | 473/566 |
| 5,931,750 A | | 8/1999 | MacKay, Jr. | 473/566 |
| 5,954,602 A | | 9/1999 | Eggiman et al. | 473/566 |
| 6,022,281 A | | 2/2000 | Nolan | 473/457 |
| 6,045,467 A | | 4/2000 | Anderson | 473/568 |
| 6,053,828 A | | 4/2000 | Pitsenberger | 473/566 |
| 6,056,655 A | | 5/2000 | Feeney et al. | 473/567 |
| 6,159,115 A | | 12/2000 | Hsu | 473/549 |
| 6,344,007 B1 | | 2/2002 | Feeney et al. | 473/567 |
| 6,443,860 B1 | | 9/2002 | Byrne et al. | 473/568 |
| 2004/0038758 A1 | * | 2/2004 | Guenther | 473/457 |

* cited by examiner

*Primary Examiner*—Mark S. Graham
(74) *Attorney, Agent, or Firm*—Rankin, Hill, Porter & Clark LLP

(57) ABSTRACT

The present invention provides a metal ball bat and a method of forming the same. The metal ball bat includes a tubular metal body including a barrel and a handle. The handle includes a gripping zone and an end. The metal ball bat also includes a collar having a first opening defined by a first edge, a second opening defined by a second edge, and an inner wall extending between the first edge and the second edge that defines an interior chamber. Part of the end of the handle extends through the first opening into the interior chamber of the collar and is flared against the inner wall of the collar to mechanically secure the collar to the handle and form a knob.

17 Claims, 5 Drawing Sheets

FIG. 6
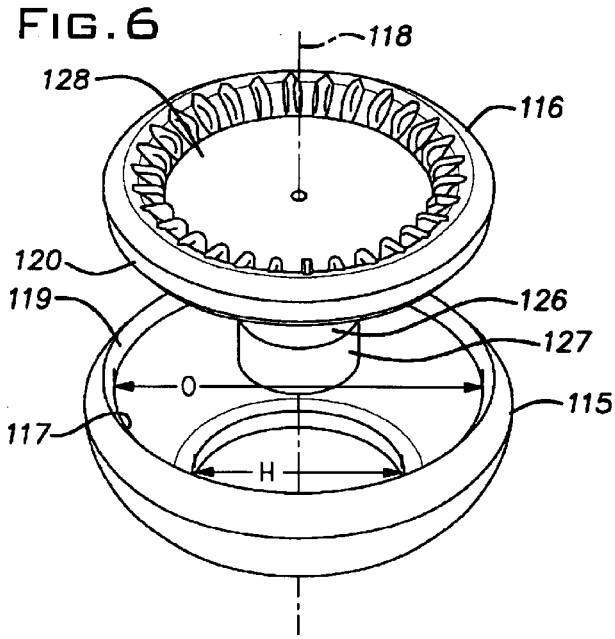
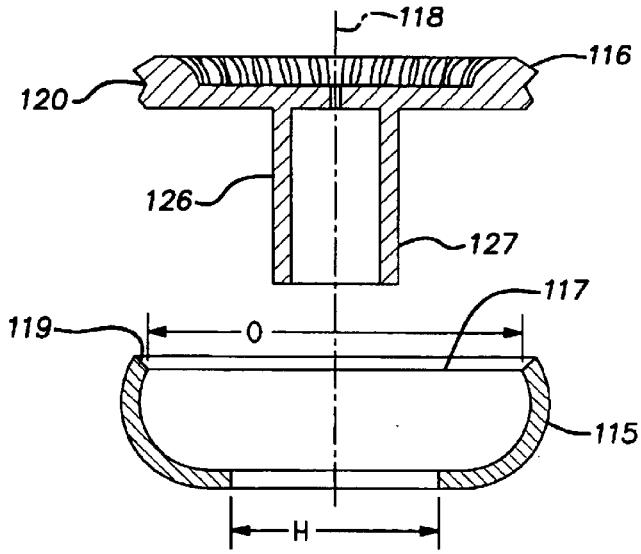
FIG. 7

KNOB FOR A METAL BALL BAT AND METHOD OF ATTACHING KNOB

This application is a continuation-in-part of Ser. No. 09/637,235 filed Aug. 11, 2000 now U.S. Pat. No. 6,443,860.

FIELD OF INVENTION

The present invention relates to a metal ball bat and more particularly to a knob for a metal ball bat and a method of attaching a knob to a metal ball bat.

BACKGROUND OF THE INVENTION

Ball bats originally used in the game of baseball were made from wood, typically hickory. These early hickory ball bats were relatively heavy, weighing as much as 42 ounces, and had relatively narrow barrels, which is the hitting portion of the bat. For a variety of reasons, ball bats are generally no longer made from hickory. Modern wood bats are made from Northern white ash, which is strong but less dense than hickory. Modern wood ball bats have a larger barrel yet weigh less than hickory bats.

Despite the advancements in wood ball bat technology over the years, the use of wood ball bats in the games of baseball and softball has declined sharply in recent years. At the present time, wood ball bats are generally used only in professional baseball leagues that have rules requiring their use. Most modern ball bats are constructed of metal.

W. A. Shroyer, Jr. is generally credited with inventing the first all-metal ball bat. See U.S. Pat. No. 1,499,128. While there were many advancements in metal ball bat technology in the following years, metal ball bats were not widely used until the mid-1970's, when several manufacturers began selling ball bats made of aluminum alloys. These early aluminum ball bats were lighter and stronger than wood ball bats, but had a tendency to dent easily. Modern metal ball bats are manufactured from exotic alloys that are stronger and lighter than the aluminum alloys first used to construct ball bats in the 1970's. Metal ball bats of this type are used in youth baseball leagues to the collegiate ranks, and in both amateur and professional softball leagues.

There have been a number of advancements in metal ball bat technology in recent years. Not surprisingly, most of these advancements have related directly or indirectly to the barrel portion of the bat. For example, Pitsenberger, U.S. Pat. No. 6,053,828, discloses a ball bat having an exterior shell disposed about the barrel portion of the bat. Eggiman, U.S. Pat. No. 5,899,823, discloses a ball bat having a performance enhancing sleeve inserted in the barrel portion of the bat. And, a number of patents disclose a variety of end caps that are inserted into the end of the barrel of the bat to prevent permanent deformation of the end of the barrel of the bat due to contact with a ball. See, e.g. Eggiman et al., U.S. Pat. No. 5,954,602, and MacKay, Jr., U.S. Pat. Nos. 5,421,572, 5,785,614, 5,785,617, and 5,931,750.

Other advancements have been made in the area of attaching the knob to the handle of the ball bat. Magadini. U.S. Pat. No. 4,940,247, teaches that a knob can be attached to a bat by welding. Scott et al., U.S. Pat. No. 4,063,732, discloses a knob fitted to the handle portion. In the Scott et al. design, there are a pair of aligned holes in the end of the handle portion and a pair of aligned holes in the knob, where an inserted pin extends through both pairs of aligned holes, securing the knob to the handle portion. Easton et al., U.S. Pat. No. 4,248,425, discloses a knob having an interior cavity, where the depth of the interior cavity is sufficient to accommodate the end of the handle. The cavity has a ring of resilient material such as gum, plastic, or rubber positioned therein. The ring is deformed by the end of the handle so that the handle fits tightly inside the knob.

Douglas et al., U.S. Pat. No. 5,094,453, discloses a bat having a handle portion and a knob, where the knob has an interior cavity, and the end of the handle portion and the interior cavity of the knob are threaded for attachment McNeely (U.S. Pat. No. 5,511,777) discloses a ridge and groove combination on the handle and the knob so that the knob snaps onto the handle. Feeney et al., U.S. Pat. No. 6,056,655, discloses the use of an adhesive to attach the knob to the handle of the bat.

Despite the recent advancements in metal ball bat technology, there remains substantial room for improvement. The prior methods have been typically subject to objection on account of their ease with which the first secured knob may become later detached, either by deliberate act or by accident as an incident of normal use of the ball bat.

SUMMARY OF INVENTION

The present invention relates to a metal ball bat, and more particularly a knob for a metal ball bat and a method of attaching a knob to a metal ball bat. A metal ball bat according to the invention comprises an elongated tubular metal body having a barrel at one end and a handle at an opposite end. The handle comprises a gripping zone and an end, or tip, which extends from the handle. The handle terminates in a knob that comprises: a metal collar, the end that extends from the handle, and a plug that is retained in an opening in the collar. Preferably, the opening in the collar is substantially perpendicular to a longitudinal axis of the elongated tubular metal body.

The collar preferably has a first opening defined by a first edge in a first wall and a second opening defined by a second edge in a second opposing wall, where the first wall and the second wall are spaced apart from each other and define an interior chamber within the collar. The end extends through the first opening into the collar. The handle of the bat includes a seat that contacts the first wall of the collar, and the collar rests on the seat. In one preferred embodiment, the seat may be formed by machining ½" to ¾" of the gripping zone to a reduced diameter, thus forming the end. The seat is located where the end meets the gripping zone. The end extends into the interior chamber of the collar to attach the handle to the collar and form the knob. In another preferred embodiment, the seat may be formed using a sizing die, which reduces the diameter of a ½" to ¾" section of the gripping zone to create the end portion that extends through the collar. The use of a sizing die forms a small bulge in the handle.

Once the end is placed in the interior chamber of the collar, the end is swaged or flared toward an inner contact region of the collar. In this swaging or flaring process, the diameter of the end is increased so that it is larger than the diameter of the first opening. One method of accomplishing this is to use a swaging or flaring die. After swaging or flaring, the end may come into contact with the inner surface of the collar at the inner contact region, which ensures that the collar will be immovable once attached to the handle. Before the end is swaged or flared, it is heated to a temperature of from about 600° F. to about 1000° F., more preferably from about 700° F. to about 900° F. This heating raises the aluminum alloy to a plastic state, and permits successful mechanical attachment of the two parts by swaging or flaring die without cracking the handle material resulting in a weakening of the joint. This arrangement provides a very effective mechanical joint which resists both longitudinal and circumferential movement of the knob relative to the tubular body.

The second opening in the collar receives the plug. The plug is preferably retained in the second opening by means of a snap-fit connection engaging the second edge that defines the second opening in the collar and a groove in the plug. Alternatively, the plug is retained in the second opening in the collar by means of a bayonet coupling between the plug and the collar. In one preferred embodiment of the invention, the plug further comprises a stem portion that fits into a cavity in the handle when the plug is retained in the opening in the collar. The stem portion can further comprise one or more weights for adjusting the swing characteristics of said ball bat. Preferably, the plug is formed of a polymeric material such as thermoplastic polyurethane elastomer and the collar is formed of formed from an aluminum alloy such as 5052-H32 aluminum alloy. In one preferred embodiment of the invention, the plug has an exposed surface that projects substantially beyond the plane of the second opening in the collar to provide an extended gripping surface when the plug is retained in the second opening of the collar.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

FIG. 6 is an exploded perspective view of a plug and a collar according to the present invention.

FIG. 7 is an exploded side sectional view of the plug and collar shown in FIG. 6.

DETAILED DESCRIPTION OF THE PREFERRED EMBODIMENT

Figure 1:
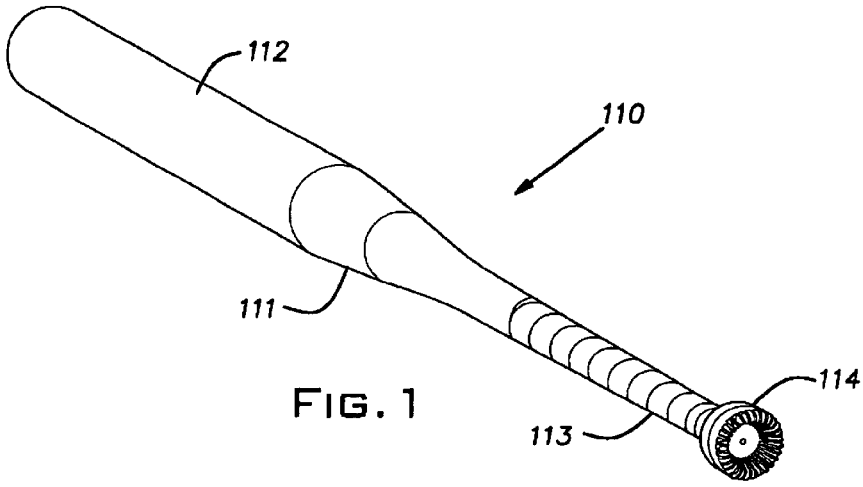
FIG. 1 is a perspective view of one embodiment of a ball bat according to the present invention.
Figure 2:
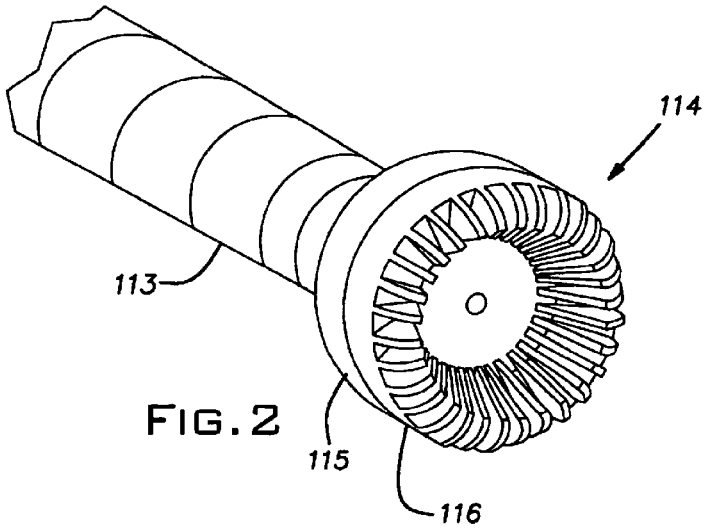
FIG. 2 is a perspective view of a portion of the ball bat shown in FIG. 1.

With reference to FIG. 1, the present invention is directed to a metal ball bat 110 that comprises an elongated tubular metal body 111 having a barrel portion 112 at one end and a handle 113 at an opposite end. The handle 113 defines a cavity and terminates a knob 114. With reference to FIG. 2, the knob 114 comprises a metal collar 115 that extends from the handle 113 and a plug 116 that is retained in a second opening 117 (not shown in FIG. 2) in the collar 115. Preferably, the collar 115 is formed from an aluminum alloy such as 5052-H32 aluminum alloy and as attached to the handle 113 of the elongated tubular metal body 111.

Figure 3:
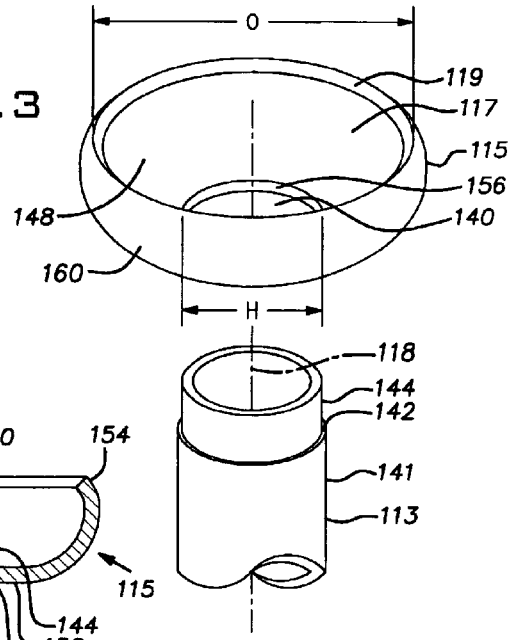
FIG. 3 is an exploded perspective view of a collar and a handle of a ball bat.
Figure 4:
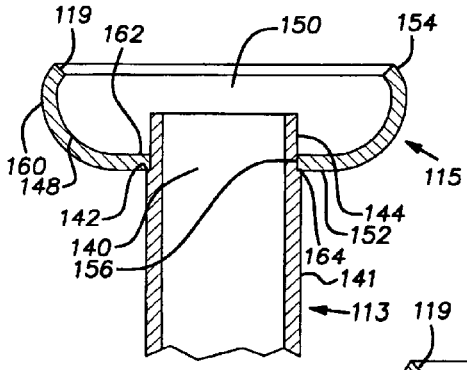
FIG. 4 is a side sectional view of the collar and handle of a ball bat shown in FIG. 3 prior to swaging.

With reference to FIGS. 3 and 4, the collar includes a first wall 152 having a first opening 140 defined by a first edge 156, and an opposing second wall 154 having a second opening 117 defined by a second edge 119, where the first wall 152 and the second wall 154 are spaced apart from each other and define an interior chamber 150 within the collar 115. The first opening 140 and the second opening 117 in the collar 115 are substantially perpendicular to a longitudinal axis 118 of the elongated tubular metal body 111 (not shown). The passage 150 shares a common longitudinal axis with the longitudinal axis 118 of the elongated tubular metal body. The collar 115 has an inner surface 148 and an outer surface 160. The first opening 140 and the second opening 117 each have a diameter, where the diameter "H" of the first opening 140 is smaller than the diameter of the second opening "O" 117.

With reference to FIG. 3, the handle 113 comprises a gripping zone 141 and an end 144 that extends from the handle 113. The end 144 extends from about ½" to about ¾" from the gripping zone 141. The end 144 has a diameter that is smaller than the diameter of the gripping zone 141. The end 144 and the gripping zone 141 meet to form a seat 142. The end 144 extends into the interior chamber 150 of the collar to attach the handle 113 to the collar 115 and form the knob.

With reference to FIG. 4, when attaching the collar 115 to the handle 113, the end 144 is inserted into the interior chamber 150, and extends through the first opening 140 in the first wall 152 of the collar 115 toward the opposing second wall 154 of the collar 115. Upon insertion, the seat 142 engages the outer surface 160 of the first wall 152 of the collar 115 at the outer contact region 164, and prevents the collar 115 from moving further toward the barrel portion of the ball bat. The seat 142 is useful for retaining the collar 115 at the correct position for mechanical attachment.

Figure 5:
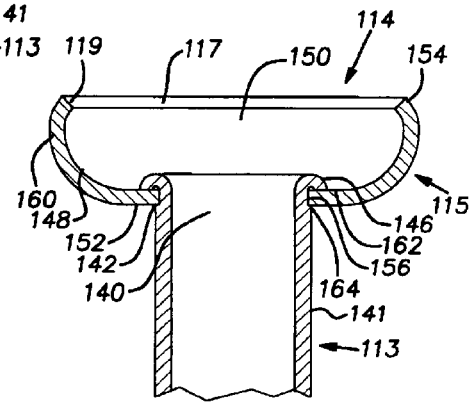
FIG. 5 is a side sectional view of the collar and handle of a ball bat shown in FIG. 4 after swaging.

With reference to FIG. 5, after the end 144 (not shown) is inserted into the interior chamber 150, the end is swaged or flared to form the altered end 146, which secures the collar 115 to the handle 113. In this swaging or flaring process, the diameter of the end 144 (not shown) is increased to a diameter larger than the diameter of the first opening 140. The end 144 is also bent toward the inner surface 148 of the collar 115 and meets the inner surface 148 at the inner contact region 162. The altered end 146 contacts the inner surface 148 of the collar 115, while the seat 142 engages the outer contact region 164, thereby securing the collar 115 to the handle 113. The first wall 152 of the collar 115 is secured between the seat 142 and the altered end 146. Upon securing the collar 115 to the handle 113, the plug 116 may be inserted into the second opening 117 in the collar 115, which completes the formation of the knob 114.

With reference to FIGS. 6 and 7, the second opening 117 in the collar 115 is substantially perpendicular to a longitudinal axis 118 of the elongated tubular metal body 111. Preferably, the diameter O of the second opening 117 in the collar 115 is greater than the diameter H of the first opening 140.

The collar 115 and the handle 113 are preferably formed from aluminum or an aluminum alloy. The first opening 140 and the second opening 117 of the collar 115 each have a diameter, where the diameter H of the first opening 140 is smaller than the diameter O of the second opening 117. The diameter of the second opening 117 should be large enough so that a swaging or flaring die can fit inside the second opening 117 to form the altered end 146. The diameter of the first opening 140 is also smaller than the diameter of the gripping zone 141, but is greater or equal to the diameter of the end 144. The diameter of the first opening 140 is preferably smaller than the diameter of the gripping zone 141 so that the seat 142 is effective to contact and support the first wall 152.

In one embodiment, the end 144 is formed by using an adjustable hollow mill to machine the gripping zone 141. In this embodiment, a portion of the gripping zone 141 is machined to a smaller diameter. The portion of the gripping zone having the smaller diameter forms the end 144 of the handle 113. A hollow mill or shell mill has cutters both on the inside and the outside of the mill. The hollow mill is preferably a standard hollow mill that can be used with tool holders in CNC machining centers, lathes and screw machines, or in conventional turning, milling, or automatic screw machines.

Figure 13:
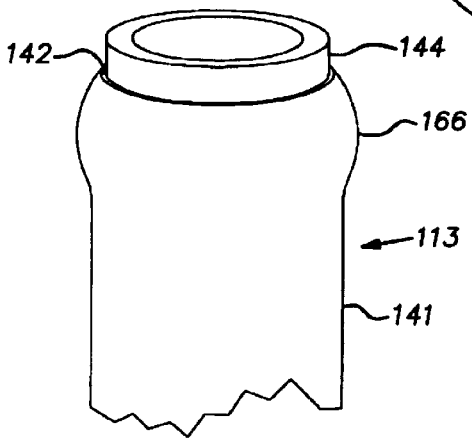
FIG. 13 is a side sectional view of another embodiment of the handle.

With reference to FIG. 13, in an alternate embodiment, the end 144 is formed using a sizing die to reduce the diameter of the gripping zone 141. Sizing changes the metal thickness and configuration by squeezing and working metal beyond the yield point. Most sizing operations are performed in open dies so that the entire workpiece is not confined in the die and the only contact between the workpiece and the die occurs in the section where the sizing takes place. When a sizing die is used to form the end 144, the gripping zone 141 is preferably not confined in the die. The metal flow is preferably unrestricted. The pressure required for this sizing operation is a factor of the area to be sized, the type of material, and the amount of change in metal thickness. A mechanical press or a hydraulic press may be used.

The use of a sizing die creates a small bulge 166 in the handle 113 adjacent the end 144. The intersection of the bulge 166 and the end forms the seat 142, which engages the first wall 152 of the collar 115. As with the machined version, the sizing die creates a seat that resembles a ledge, however, using a sizing die creates a less pronounced ledge. The bulge does not interfere with the ease of use of the ball bat or the effectiveness of the ball bat. It will be appreciated that the end 144 may be formed using other means to create a region of increased diameter on the handle 113 that would engage the outer contact region 164 of the collar 115. Such means would include a rotation tool capable of pressing a region inside the handle increasing its diameter. Also included are other means of forming a seat, including other methods for decreasing the diameter of the end of the handle or forming a bulge in the handle.

Before the end 144 is inserted into the interior chamber 150, the end 144 is preferably heated to a temperature of from about 500° F. to about 1000° F., and more preferably from about 700° F. to about 900° F. The localized heating is applied to the end 144 by induction heating, flame, or other heat source. This heating raises the aluminum or aluminum alloy to a plastic state. Immediately after heating the end 144, the end 144 is inserted through the first opening 140 into the interior chamber 150 of the collar 115.

Raising the temperature of the end 144 of the handle 113 permits successful mechanical attachment of the two parts by swaging or flaring die without cracking the end 144 resulting in a weakening of the joint. A swaging die may be placed in the second opening 117 to press the heated end 144 toward the inner contact region 162 of the collar 115. In swaging, the shape of the workpiece is considerably altered as part of it flows into the contours of a die. The remaining metal is preferably unconfined and generally flows at an angle to the direction of applied force.

A rubber sleeve or other polymeric sleeve may cover the gripping zone 141 of the handle 113. Such a sleeve further enhances the ease of use of the ball bat by providing an improved gripping surface and acting to absorb some of the shock produced when the ball bat contacts a ball.

Figure 8:
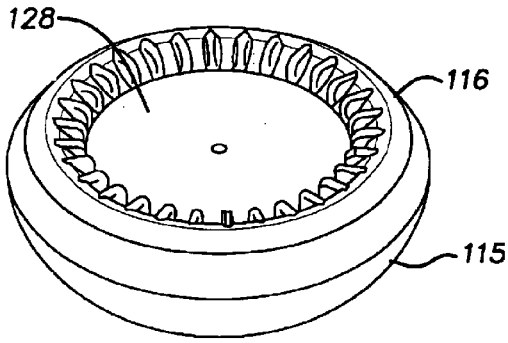
FIG. 8 is a perspective view of the assembled plug and collar shown in FIG. 6.
Figure 9:
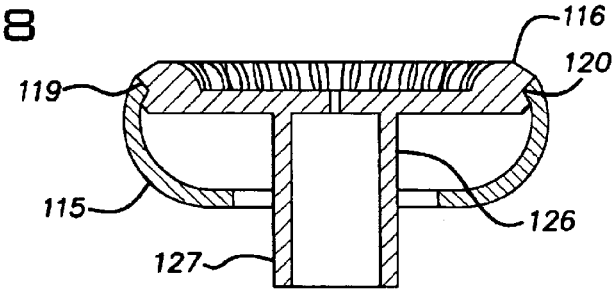
FIG. 9 is a side sectional view of the assembled plug and collar shown in FIG. 6.

In one embodiment of the invention, the second opening 117 in the collar 115 is defined by a second edge 119, and the plug 116 includes a groove 120 for engagement with the second edge 119. The plug 116 is thus retained in the second opening 117 in the collar 115 by means of a snap-fit engagement between the second edge 119 of the second opening 117 in the collar 115 and the groove 120 in the plug 116. FIGS. 6 and 8 are perspective views showing one embodiment of a plug 116 according to the present invention being snap-fit into the second opening 117 in a collar 115. FIGS. 7 and 9 are sectional side views showing one embodiment of a plug 116 according to the present invention being snap-fit into the second opening 117 in a collar 115.

Figure 10:
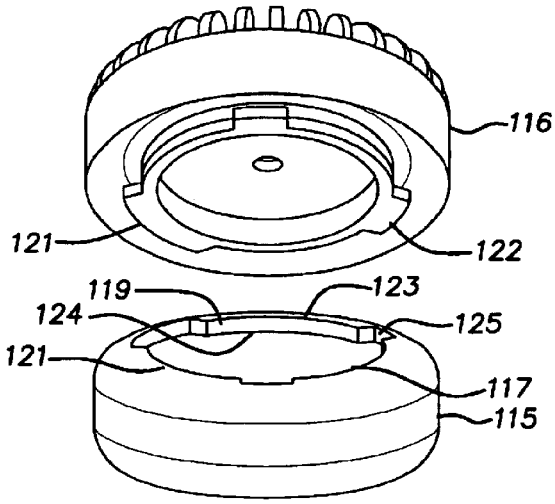
FIG. 10 is an exploded perspective view of another embodiment of the knob of a ball bat according to the present invention.

It will be appreciated that the means of connecting the plug 116 to the collar 115 is not per se critical, and that a number of connectors-can be used. In one preferred embodiment of the invention, a bayonet coupling 121 is used to attach the plug 116 to the collar 115. With reference to FIG. 10, the bayonet coupling 121 includes a plurality of tabs 122 extending outwardly around the periphery of that portion of the plug 116 that is adapted to engage with the second edge 119 of the collar 115 that defines the second opening 117. The second edge 119 of collar 115 that defines the second opening 117 comprises a radially extending rim 123, and the tabs 122 engage the underside 124 of the rim 123 when the plug 116 is pressed against the collar 115. A plurality of gaps 125 are formed in the rim 123. Each of the gaps 125 corresponds to a tab 122 so as to permit the tabs 122 to pass through the gap 125 when the plug 116 is pressed against the collar 115. The plug 116 is secured to the collar 115 when the plug 116 is rotated relative to the collar 115 so as to cause the tabs 122 to be positioned against the underside 124 of the rim 123. It will be appreciated that the underside 124 of the rim 123 can be provided with stops (not illustrated) to prohibit further rotation of the plug 116 relative to the collar 115.

Preferably, the plug 116 is formed from a polymeric material that provides sufficient resiliency to bias the tabs 122 against the underside 124 of the rim 123. The spring force provided by the inherent resiliency of the polymeric material together with a high coefficient of friction help maintains the tabs 122 in a pressed relationship relative to the underside 124 of the rim 123. The plug 116, however, can be removed from the collar 115 by pushing the plug 116 toward the collar 115 with sufficient force to overcome the spring force and frictional forces between the tabs 122 and the underside 124 of the rim 123 so that each of the tabs 122 can be rotated with respect to the collar 115 to move the tabs 122 into position where they can pass through the gaps 125. The plug 116 is then removed from the collar 115.

In the presently preferred embodiment, the plug 116 is formed from a thermoplastic polyurethane elastomer. One suitable thermoplastic polyurethane elastomer for use in the invention is available as PELLETHANE 2103-55D from the Dow Plastics Business Group of The Dow Chemical Company. It will be appreciated that the plug 116 could be formed from other polymeric materials, including polymeric materials that do not provide resiliency. In such circumstances, it is necessary to use a resilient sealing gasket between the plug 116 and the collar 115 to provide the spring force and friction necessary to keep the tabs 122 of the plug 116 in the proper relationship with the underside 124 of the rim 123.

It will also be appreciated that there are several alternative bayonet coupling configurations that can be used in the invention. For example, the tabs could be disposed around the periphery of the opening in the collar and the rim could be provided in the plug. A variety of bayonet couplings are known, and such couplings can be successfully used in the invention.

Preferably, the handle of the elongated tubular metal body defines a cavity. With reference to FIGS. 6 and 7, the plug 116 further comprises a stem portion 126 that fits into the cavity when the plug 116 is retained in the second opening 117 of the collar 115. The stem portion 126 can be formed integrally with the rest of the plug 116, or it can further comprise one or more additional components attached to the plug 116. In a preferred embodiment, the stem portion 126 comprises one or more weights 127 for adjusting the swing characteristics of the ball bat 110.

The exposed surface of the plug 116 is not per se critical. In one preferred embodiment illustrated in FIGS. 6 and 8, the plug 116 has an exposed surface 128 that does not project substantially beyond the plane of the second opening 117 in the collar 115 when the plug 116 is retained in the second opening 117 in the collar 115. In contrast, in the alternative embodiment illustrated in FIG. 11, the plug 116 has an exposed surface 128 that projects substantially beyond the plane of the second opening 117 in the collar 115 when the plug 116 is retained in the second opening 117 in the collar 115. In this alternative embodiment, a portion 129 of the exposed surface 128 provides an extended gripping surface.

Figure 11:
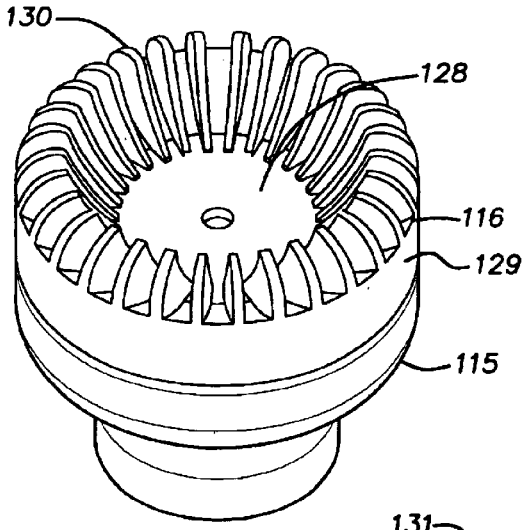
FIG. 11 is a perspective view of the assembled knob shown in FIG. 10.
Figure 12:
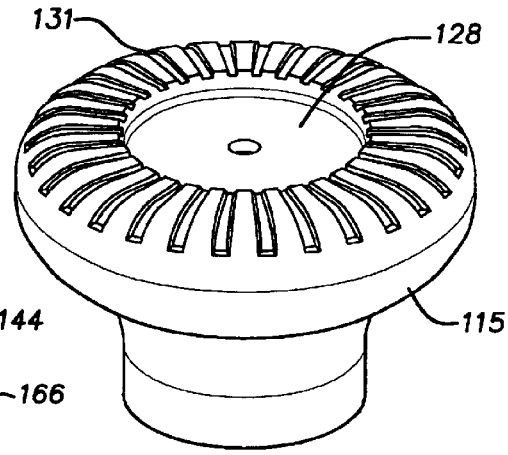
FIG. 12 is a perspective view of another embodiment of an assembled knob of a ball bat according to the present invention.

It will be appreciated that the exposed surface 128 of the plug 116 can be smooth or it can be provided with topographical features. When the exposed surface 128 of the plug 116 is provided with topographical features, a tool having the reverse impression of the topographical features on the exposed surface of the plug 116 can be used to engage such features and thus provide a means for rotating the plug 116 relative to the collar 115 to facilitate the insertion and/or removal of the plug 116 from the second opening 117 in the collar 115. For example, as is illustrated in FIGS. 11 and 12, the exposed surface 128 of the plug 116 can be provided with at least one ridge 130 and/or at least one slot 131. A tool (not illustrated) having a pair of projections for engagement with a pair of opposing ridges 130 or slots 131 could then be used to rotate the plug 116 relative to the collar 115 to facilitate the insertion and/or removal of the plug 116 from the second opening 117 in the collar 115. It will be appreciated that the tool used to facilitate insertion and/or removal of the plug 116 from the second opening 117 in the collar 115 could be multi-functional. For example, the tool could include a bottle opener, a lid lifter, and/or a pick for cleaning debris from cleats or spikes. Furthermore, such tool could be configured such that it could be retained on a key ring.

It will be appreciated that the exposed surface 128 of the plug 116 can be formed with any number of ornamental features and designs to increase the marketability of the ball bat. Ball bats are typically displayed for sale in bat racks that feature a hole that is larger than the diameter of the handle of the ball bat, but smaller than the diameter of the knob. The ball bat hangs vertically from the bat rack with only the bottom of the knob being visible to the prospective purchaser. A knob that is highly colored or features unique ornamental designs or other indicia is likely to draw a prospective purchaser's attention more readily than a ball bat having a conventional knob consisting of a metal cap with a paper label adhered thereto.

The ball bat according to the present invention facilitates the manufacture of ball bats. The elongated tubular metal body can be constructed according to conventional means from any of the known ball bat materials presently being used.

A ball bat according to the present invention provides several advantages as compared to prior art ball bats. For example, when the plug is formed of a polymeric material, the polymeric material has a tendency to absorb and thereby dampen shock and/or vibration caused when the barrel portion of the ball bat strikes a ball. Additionally, handle and knob are securely joined by a relatively simple process that can be performed without the use of elaborate or complex electrical equipment such as that required for welding or electromagnetic forming, as previously practiced.

Another advantage provided by the ball bat according to the present invention relates to the extended gripping surface provided when the exposed surface of the plug projects beyond the plane of the opening in the collar when the plug is retained in the opening. Many softball players have been holding prior art softball bats such that one or two of their fingers are actually off the bottom of the knob. The extended gripping surface provided by the exposed surface of the plug according to the present invention permits these softball players to obtain a better and more reliable grip the bat. This cuts down on the number of bats that fly out of player's hands during the game.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A ball bat comprising:

a tubular metal body comprising a barrel and a handle, the handle comprising a gripping zone and an end, the diameter of the gripping zone being larger than the diameter of the end at a transition between the gripping zone and the end to form a seat; and a collar having a first opening defined by a first edge, a second opening defined by a second edge, and an inner wall extending between the first edge and the second edge that defines an interior chamber;

wherein a part of the end of the handle extends through the first opening into the interior chamber of the collar and is flared against the inner wall of the collar to mechanically secure the collar to the handle at the seat to form a knob.

2. A ball bat comprising:

a tubular metal body comprising a barrel and a handle, the handle comprising a gripping zone and an end, the transition between the gripping zone and the end forming a seat; and a collar having a first opening defined by a first edge, a second opening defined by a second edge, and an inner wall extending between the first edge and the second edge that defines an interior chamber, the diameter of the first opening being smaller than the diameter of the second opening;

wherein a part of the end of the handle extends through the first opening into the interior chamber of the collar and is flared against the inner wall of the collar to mechanically secure the collar to the handle at the seat to form a knob.

3. The ball bat according to claim 1, wherein the end of the handle is about ½" to about ¾" in length.

4. A ball bat comprising:

a tubular metal body comprising a barrel and a handle, the handle comprising a gripping zone and an end, the transition between the gripping zone and the end forming a seat; and a collar having a first opening defined by a first edge, a second opening defined by a second edge, and an inner wall extending between the first edge and the second edge that defines an interior chamber, the diameter of the end being smaller than the diameter of the second opening of the collar;

wherein a part of the end of the handle extends through the first opening into the interior chamber of the collar and is flared against the inner wall of the collar to mechanically secure the collar to the handle at the seat to form a knob.

5. A ball bat comprising:

a tubular metal body comprising a barrel and a handle, the handle comprising a gripping zone and an end, the transition between the gripping zone and the end forming a seat, the handle being machined such that the end has a diameter that is smaller than the diameter of the gripping zone; and a collar having a first opening defined by a first edge, a second opening defined by a second edge, and an inner wall extending between the first edge and the second edge that defines an interior chamber;

wherein a part of the end of the handle extends through the first opening into the interior chamber of the collar and is flared against the inner wall of the collar to mechanically secure the collar to the handle at the seat to form a knob.

6. The ball bat according to claim 1, wherein a sizing die is used to form the seat.

7. The ball bat according to claim 1, wherein the tubular metal body and collar are each formed from an aluminum alloy.

8. The ball bat according to claim 7 wherein the aluminum alloy is 5052-H32 aluminum alloy.

9. A method of forming a ball bat comprising:

providing a tubular metal body comprising a barrel and a handle, the handle comprising a gripping zone and an end, the diameter of the gripping zone being larger than the diameter of the end at a transition between the gripping zone and the end to form a seat;

providing a collar having a first opening defined by a first edge, a second opening defined by a second edge and an inner wall extending between the first edge and the second edge that defines an interior chamber;

heating the end of the handle;

inserting the end of the handle into the interior chamber of the collar through the first opening; and flaring the end of the handle against the inner wall of the collar to mechanically secure the collar to the handle at the seat to form a knob.

10. A method of forming a ball bat according to claim 9 wherein the diameter of the first opening is smaller than the diameter of the second opening.

11. A method of forming a ball bat according to claim 9 wherein the end of the handle is about ½" to about ¾" in length.

12. A method of forming a ball bat according to claim 9 wherein the diameter of the end is smaller than the diameter of the second opening in the collar.

13. A method of forming a ball bat according to claim 9 wherein the handle is machined to form the end having a diameter that is smaller than the diameter of the gripping zone at the transition.

14. A method of forming a ball bat according to claim 9 wherein a sizing die is used to form the seat.

15. A method of forming a ball bat according to claim 9 wherein the tubular metal body and collar are each formed from an aluminum alloy.

16. A method of forming a ball bat according to claim 9 wherein the aluminum alloy is 5052-H32 aluminum alloy.

17. A method of forming a ball bat according to claim 9 wherein the end is heated to a temperature of from about 600° F. to about 1000° F. before it is inserted into the interior chamber.

* * * * *